US010953565B2

(12) United States Patent
Carmen, Jr. et al.

(10) Patent No.: US 10,953,565 B2
(45) Date of Patent: Mar. 23, 2021

(54) LOG SPLITTER

(71) Applicant: Bluebird Turf Products LLLP, Auburn Hills, MI (US)

(72) Inventors: Anthony Joseph Carmen, Jr., Bloomfield Hills, MI (US); Nicholas Anthony Salvatore, Shelby Township, MI (US)

(73) Assignee: Bluebird Turf Products, LLLP, Auburn Hills, MI (US)

( * ) Notice: Subject to any disclaimer, the term of this patent is extended or adjusted under 35 U.S.C. 154(b) by 104 days.

(21) Appl. No.: 16/164,533

(22) Filed: Oct. 18, 2018

(65) Prior Publication Data

US 2019/0111584 A1 Apr. 18, 2019

Related U.S. Application Data

(60) Provisional application No. 62/573,884, filed on Oct. 18, 2017.

(51) Int. Cl.
*B27L 7/06* (2006.01)
*B27L 7/00* (2006.01)

(52) U.S. Cl.
CPC .. *B27L 7/06* (2013.01); *B27L 7/00* (2013.01)

(58) Field of Classification Search
CPC ..... B27L 7/00; B27L 7/06
See application file for complete search history.

(56) References Cited

U.S. PATENT DOCUMENTS 3,285,304 A * 11/1966 Fuller ..... B27L 7/00 144/193.1
3,779,295 A * 12/1973 Balsbaugh ..... B21D 7/06 144/195.1
4,252,165 A * 2/1981 Hansen ..... B27L 7/00 144/195.1
4,275,779 A * 6/1981 Rowe ..... B27L 7/00 144/195.1
4,461,331 A * 7/1984 Mertz ..... B27L 7/00 144/195.1
6,318,424 B1 * 11/2001 Elfrink ..... B21D 5/02 144/193.1
7,255,143 B1 * 8/2007 Babcock ..... B27L 7/06 144/193.1

(Continued)

OTHER PUBLICATIONS

Barreto Mfg. Inc., Barreto 920LS Log Splitter Safety Procedures, May 18, 2017, https://www.youtube.com/watch?v=QyKxh7lHdrU (Year: 2017).*

*Primary Examiner* — Matthew Katcoff
(74) *Attorney, Agent, or Firm* — Jennings, Strouss & Salmon PLC; Daniel R. Pote

(57) ABSTRACT

A wedge mounting bracket for a log splitter includes a mounting plate and a female slot into which a corresponding male adapter of the wedge is received. In particular, a replaceable wedge includes a knife edge and a male adapter configured to be slideably received within the female slot of the mounting bracket. A through hole in the wedge is configured to align with a corresponding through hole in the mounting bracket to releasably secure the wedge within the mounting bracket using a nut and bolt assembly. In this way, the wedge may be conveniently removed from the log splitter for sharpening, while leaving the load bearing mounting hardware intact.

19 Claims, 14 Drawing Sheets

(56) References Cited

U.S. PATENT DOCUMENTS

| | | | | |
|---|---|---|---|---|
| 8,960,227 | B2 * | 2/2015 | Smith | F15B 21/044 137/574 |
| 9,381,668 | B2 * | 7/2016 | Banjo | B27L 7/00 |
| 10,118,309 | B2 * | 11/2018 | Bowman | B27L 7/00 |
| 2011/0079323 | A1 * | 4/2011 | Green | B27L 7/06 144/195.8 |
| 2013/0000785 | A1 | 1/2013 | Banjo et al. | |
| 2019/0030749 | A1 * | 1/2019 | Janowski | B27L 7/06 |

* cited by examiner

LOG SPLITTER

RELATED APPLICATIONS

This application claims the benefit of and priority to U.S. Provisional Patent Application Ser. No. 62/573,884, filed Oct. 18, 2017, and entitled "Log Splitter", the entire disclosure of which is hereby incorporated by reference.

TECHNICAL FIELD

The present invention relates, generally, to a device for splitting logs and, more particularly, to log splitter having a removable wedge knife.

BACKGROUND

Conventional log splitters include a platform for receiving a log to be split, a cutting wedge, and a powered mechanism configured to urge the wedge against and into the log to thereby split the log. In presently known log splitters, the wedge is welded to a base plate or otherwise immovably secured to the log splitter chassis, rendering it impractical to remove the wedge for sharpening.

U.S. Patent Publication 2013/0000785 A1 published Jan. 3, 2013 describes a log splitter having a safety release member operable by a first hand of a user, and a splitter activation member operable by a second hand of the user, such that simultaneous operation of both the safety release member and the splitter activation member are required to enable operation of the log splitter. However, the safety release member and the splitter activation member are separated from each other by a significant distance to prevent one-handed operation of both the safety release member and the splitter activation member. This disadvantageous in that it can be cumbersome and physically taxing for the user.

Log splitters capable of operating in both a horizontal and vertical orientation are available from Iron & Oak located in Rogers, Minn. However, many presently known dual orientation log splitters are not well suited for bumpy or otherwise uneven terrain.

Finally, existing tractor drawn log splitters are subject to tipping when turning corners while being transported, in part due to weight shifting of the fluid within the tank which supplies the hydraulic actuator.

Systems and methods are thus needed which overcome the foregoing and other limitations of the prior art.

Various additional features and characteristics will also become apparent from the subsequent detailed description and the appended claims, taken in conjunction with the accompanying drawings and this background section.

BRIEF SUMMARY

Various embodiments of the present invention disclose a log splitter having a wedge mounting configuration which allows the wedge to be removed and replaced to facilitate re-sharpening ex situ. Various embodiments of the log splitter include a two factor safety system, which may be implemented as a two handed operation to reduce the likelihood of inadvertent operation, without unnecessarily taxing the operator. The log splitter may be configured for adjustable positioning of the main I-beam to accommodate differing ground levels when the splitter is used in the vertical orientation. Other embodiments contemplate a baffled hydraulic fluid tank to reduce instability while transporting the log splitter.

Various embodiments provide a wedge mounting bracket, which includes a mounting plate and a female slot into which a corresponding male adapter of the wedge is received. In particular, a replaceable wedge includes a knife edge/male adapter assembly configured to be slideably received within the female slot of the mounting bracket. A through hole in the wedge is configured to align with a corresponding through hole in the mounting bracket to releasably secure the wedge within the mounting bracket using a nut and bolt assembly during use. In this way, the wedge may be conveniently removed from the log splitter for sharpening, without having to remove the load bearing mounting hardware.

Various other embodiments, aspects, and features are described in greater detail below.

BRIEF DESCRIPTION OF THE DRAWING FIGURES

Exemplary embodiments will hereinafter be described in conjunction with the following drawing figures, wherein like numerals denote like elements, and:

DETAILED DESCRIPTION

The following detailed description of various embodiments of the invention is merely exemplary in nature and is not intended to limit the invention or the application and uses of the invention. Furthermore, there is no intention to be bound by any theory presented in the preceding background or the following detailed description.

Various embodiments of the present invention relate to a log splitter which overcomes many of the drawbacks of presently known log splitters. In accordance with various embodiments, a mobile chassis supports a log splitter having a wedge configured to be easily removed and replaced to allow the user to re-sharpen the wedge, as needed. The present invention also provides for two-handed operation to reduce the likelihood of inadvertent activation of the splitting mechanism, without requiring the user to reach across a large distance. The log splitter further provides a slotted pivot mechanism for manually adjusting the log splitter between vertical and horizontal operational modes. In accordance with a further aspect of the present invention, a baffled fluid (e.g., oil) tank reduces instability during transport.

Figure 1:
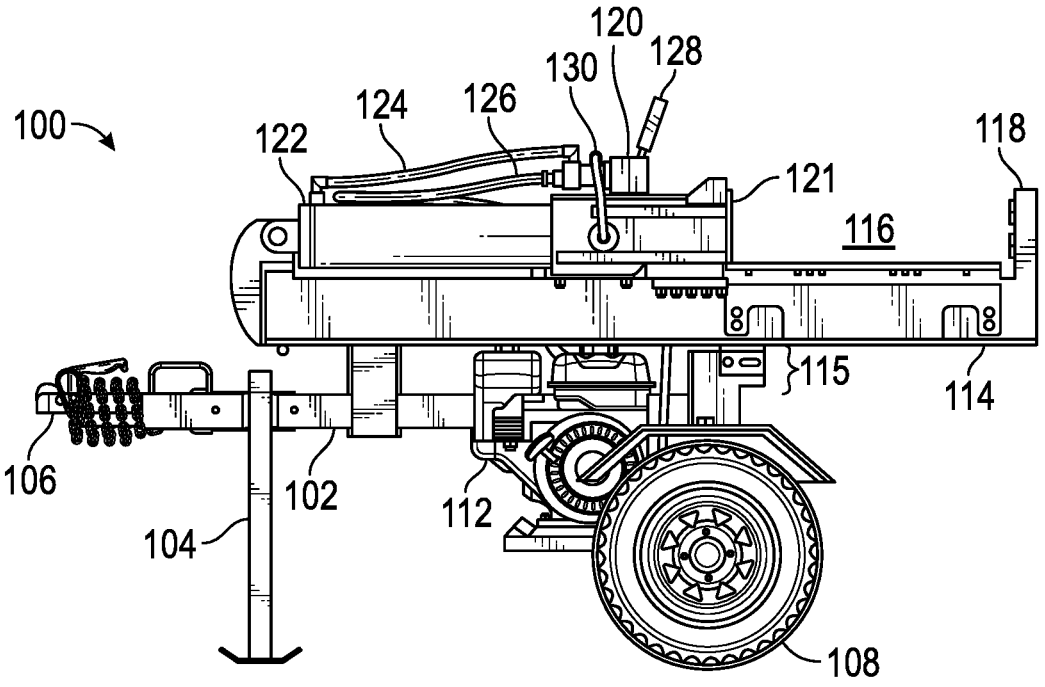
FIG. 1 is a left side elevation view of a mobile log splitter system in accordance with various embodiments.

Referring now to FIG. 1, a log splitter 100 includes a chassis 102 having a stand 104, a trailer hitch 106, and wheels 108. The chassis supports a power plant (e.g., motor) 112 and an I-beam 114 configured to rotate, for example, about a slotted pivot mount 115. The log splitter assembly includes a platform or bay 116 bounded by an end plate 118 into which logs (not shown) may be placed for splitting. A pump 120 supplies pressurized fluid to a hydraulic cylinder 122 to selectively extend a wedge 121 into the log bay 116 to thereby split the log, and thereafter retract the wedge from the log and log bay.

A two factor safety system includes a primary actuator 128 and a secondary safety actuator 130. When the operator simultaneously actuates both levers, high pressure fluid is supplied through a first conduit (e.g., hose) 124 to cause an internal piston (not shown for clarity) to extend the wedge 121 into the log (e.g., from left-to-right in FIG. 1), forcing the opposite end of the log against end plate 118 whereupon the wedge splits the log. Thereafter, lower pressure fluid is ported to the other side of the piston via conduit 126, causing the wedge to retract from the log (e.g., from right-to-left in FIG. 1).

Figure 2:
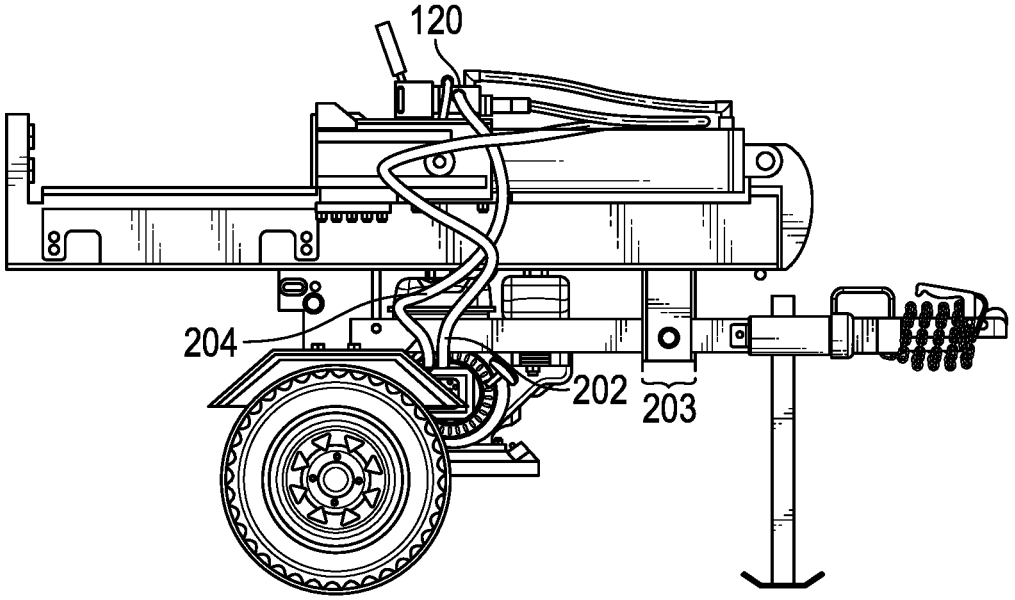
FIG. 2 is a right side elevation view of the log splitter of FIG. 1 in accordance with various embodiments.

FIG. 2 is a right side elevation view of the log splitter of FIG. 1, illustrating supply and return conduits 202, 204 extending between the compressor 120 and a hydraulic storage tank (not fully shown in FIG. 2), as described in greater detail below in conjunction with FIGS. 19 and 20. A release assembly 203 allows the user to selectively pivot the log splitter between horizontal and vertical operational modes, as described in greater detail below.

Figure 3:
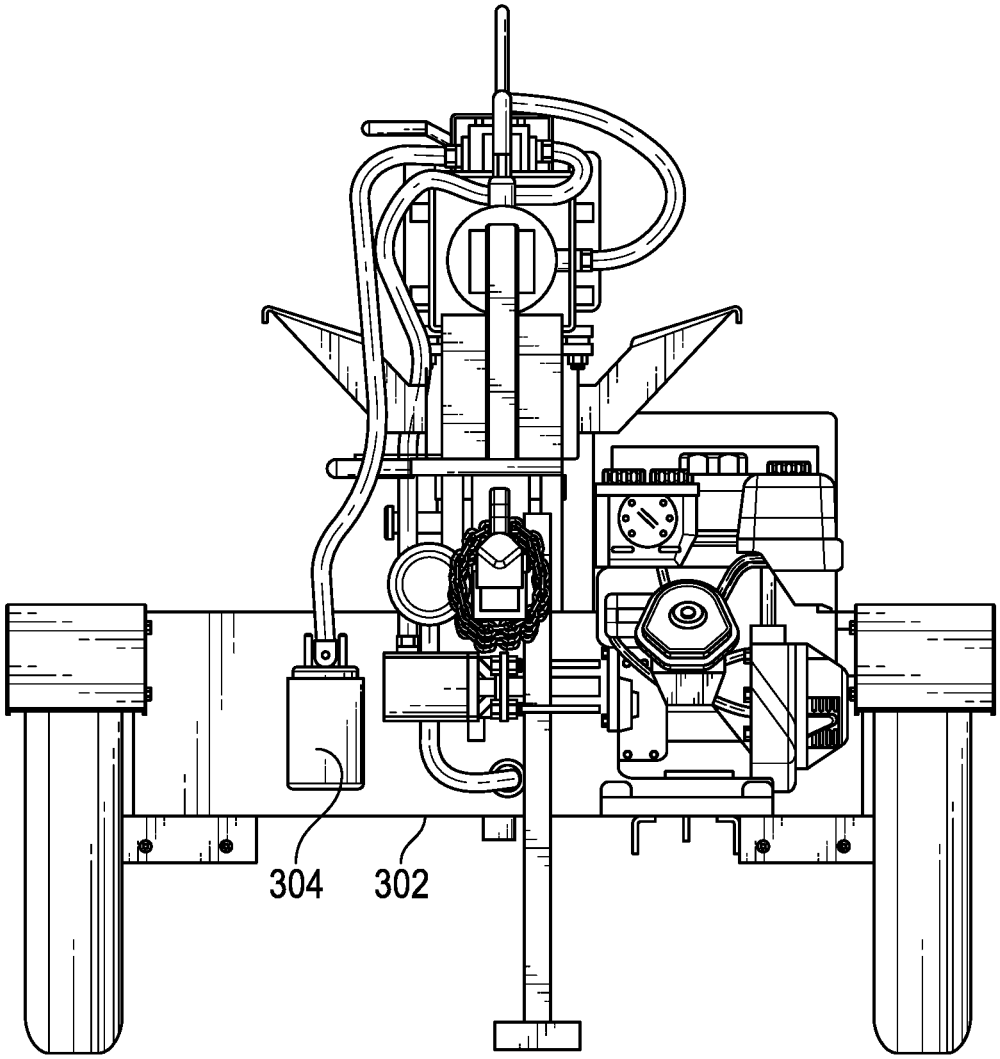
FIG. 3 is a front elevation view of the log splitter of FIG. 1 in accordance with various embodiments.

FIG. 3 is a front elevation view of the log splitter of FIGS. 1 and 2, showing the hydraulic tank 302 and an in-line fluid filter 304.

Figure 4:
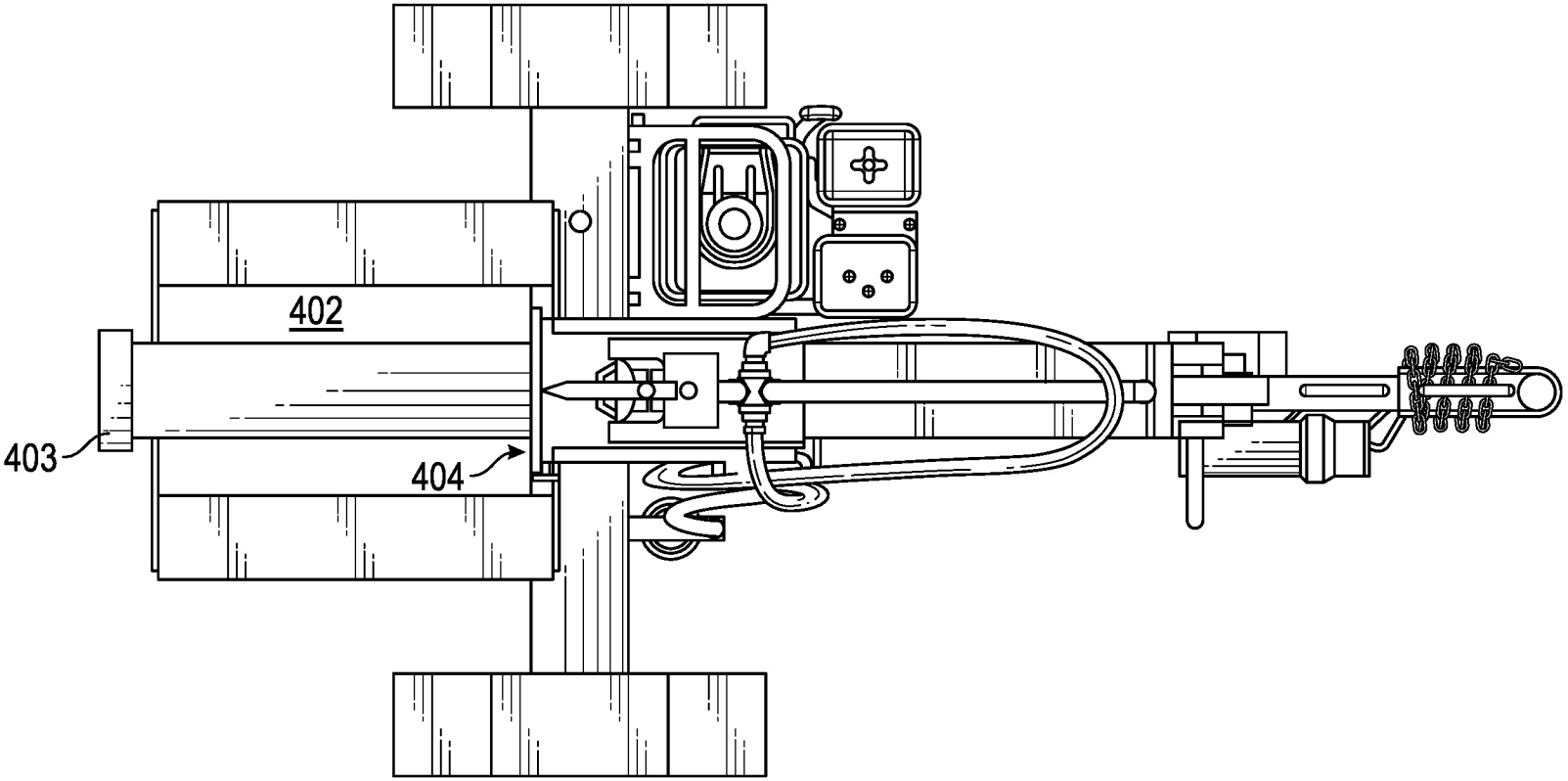
FIG. 4 is a rear elevation view of the log splitter of FIG. 1 in accordance with various embodiments.

FIG. 4 is a top plan view of the log splitter of FIGS. 1-3, illustrating a log platform 402 for receiving a log, an endplate 403, and a wedge assembly 404.

Figure 5:
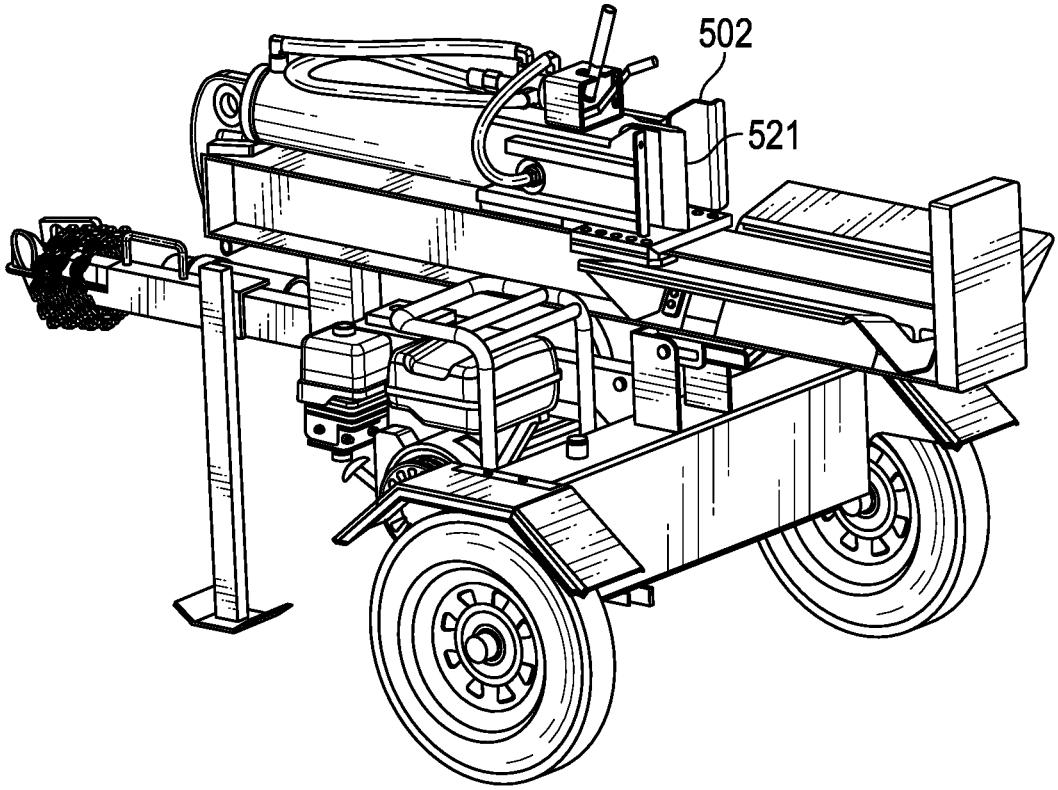
FIG. 5 is a perspective view of the log splitter of FIG. 1 in accordance with various embodiments.

FIG. 5 is a perspective view of the log splitter of FIGS. 1-4, showing an exemplary wedge 521 disposed between opposing retaining brackets 502. More particularly, after the wedge splits the log and retracts back towards the cylinder (to the left in FIG. 5), sometimes the wedge can become stuck in the log, carrying the log back to the left with the wedge as it retracts. To help remove the wedge from a partially but not completely split log, the retaining brackets 502 provide a hard stop for the log as the wedge 521 continues to travel back toward the cylinder, forcing the removal of the wedge 521 from the log.

Figure 6:
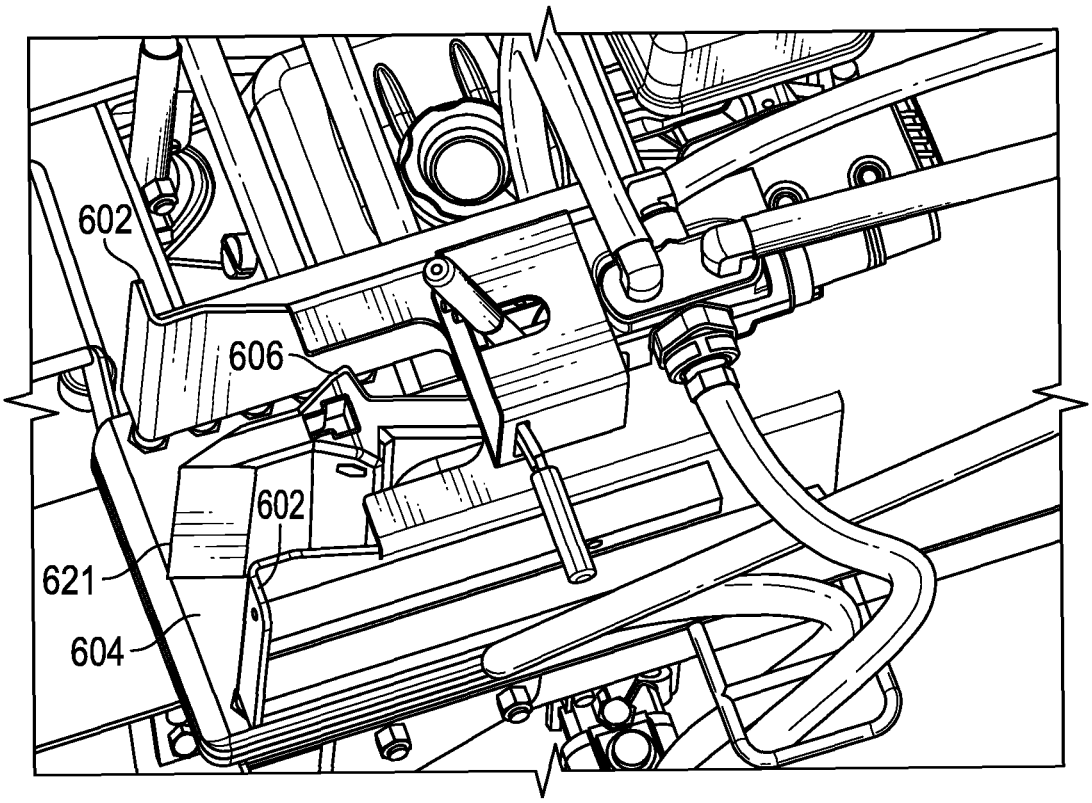
FIG. 6 is a detail view of the splitting wedge assembly in accordance with various embodiments.
Figure 7:
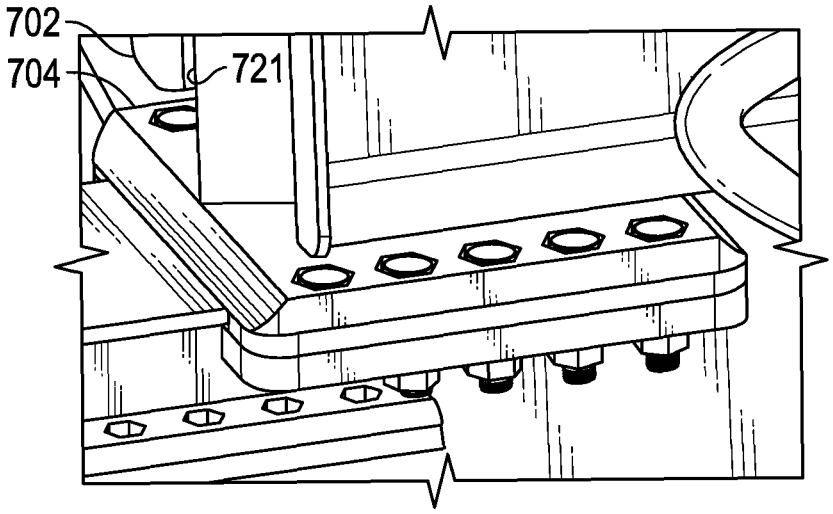
FIG. 7 is a close up view of a portion of the wedge mounting bracket in accordance with various embodiments.

Referring now to FIG. 6, the wedge assembly includes a removable wedge 621, respective retaining brackets 602, and a mounting plate 604 having an upwardly extending mounting bracket 606 configured to receive the wedge 621. With momentary reference to FIG. 7, a close up view shows wedge 721 disposed between retaining brackets 702 (analogous to brackets 502 and 602 of FIGS. 5 and 6, respectively), and a mounting plate 704 (analogous to mounting plate 604 of FIG. 6).

Figure 8:
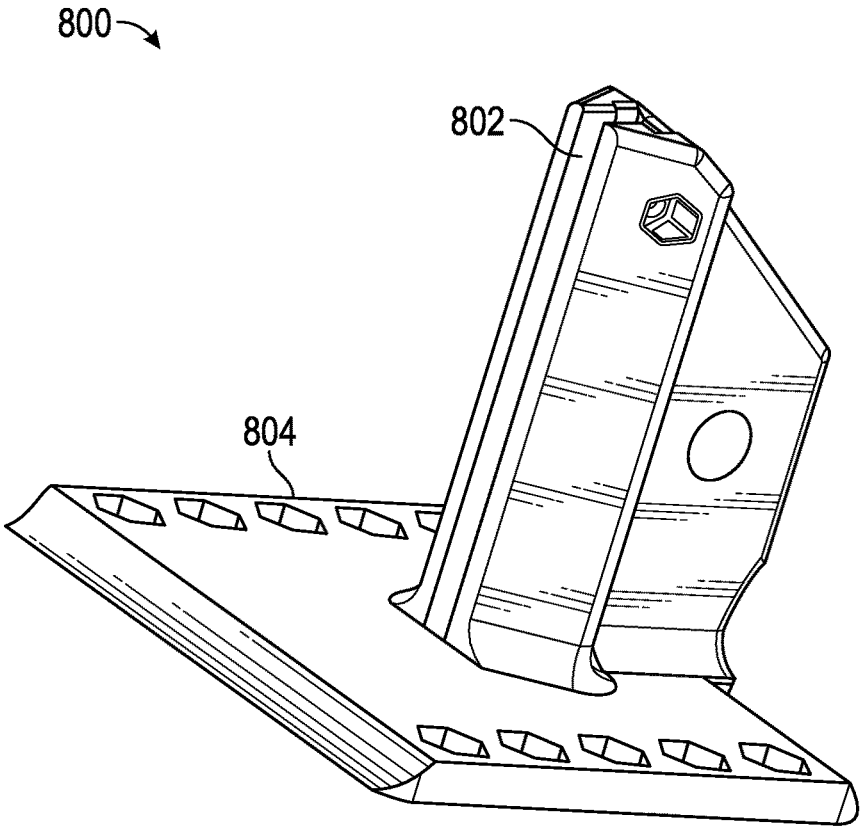
FIG. 8 is a perspective view of a single piece slotted mounting bracket in accordance with various embodiments.
Figure 9:
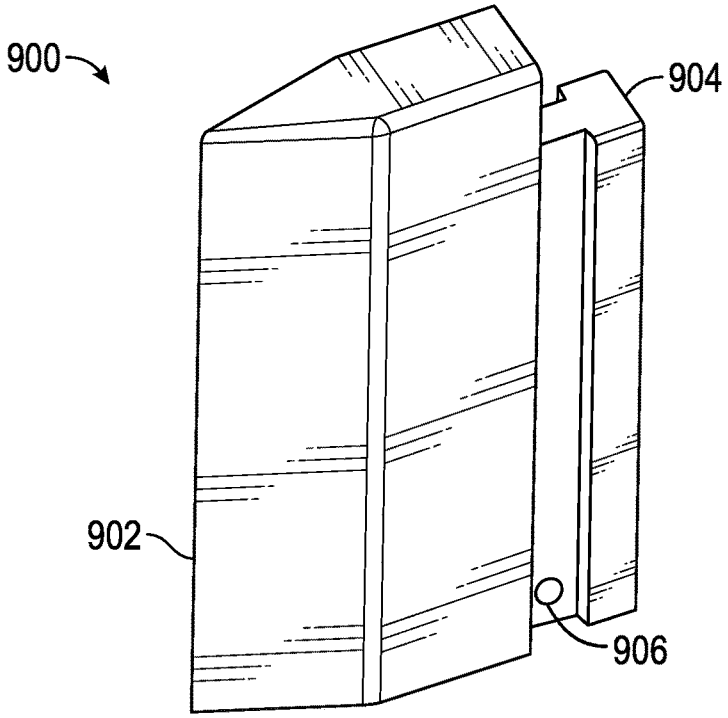
FIG. 9 is a perspective view of a replaceable wedge configured to be received within the slotted bracket shown in FIG. 8 in accordance with various embodiments.

FIG. 8 is a perspective view of a single piece slotted mounting bracket 800 including a mounting plate 804 and a female slot 802 into which a corresponding male adapter of the wedge is received. More particularly and with reference to FIG. 9, a replaceable wedge 900 includes a knife edge 902 and a male adapter 904 configured to be slideably received within the female slot 802 of the mounting bracket shown in FIG. 8. A through hole 906 in the wedge 900 is configured to align with a corresponding through hole in the mounting bracket to releasably secure the wedge 900 within the mounting bracket using any suitable fastener such as a nut and bolt assembly. In this way, the wedge 900 may be securely attached to the log splitter during use, yet conveniently removed from the log splitter for sharpening while leaving the load bearing mounting hardware intact.

Figure 10:
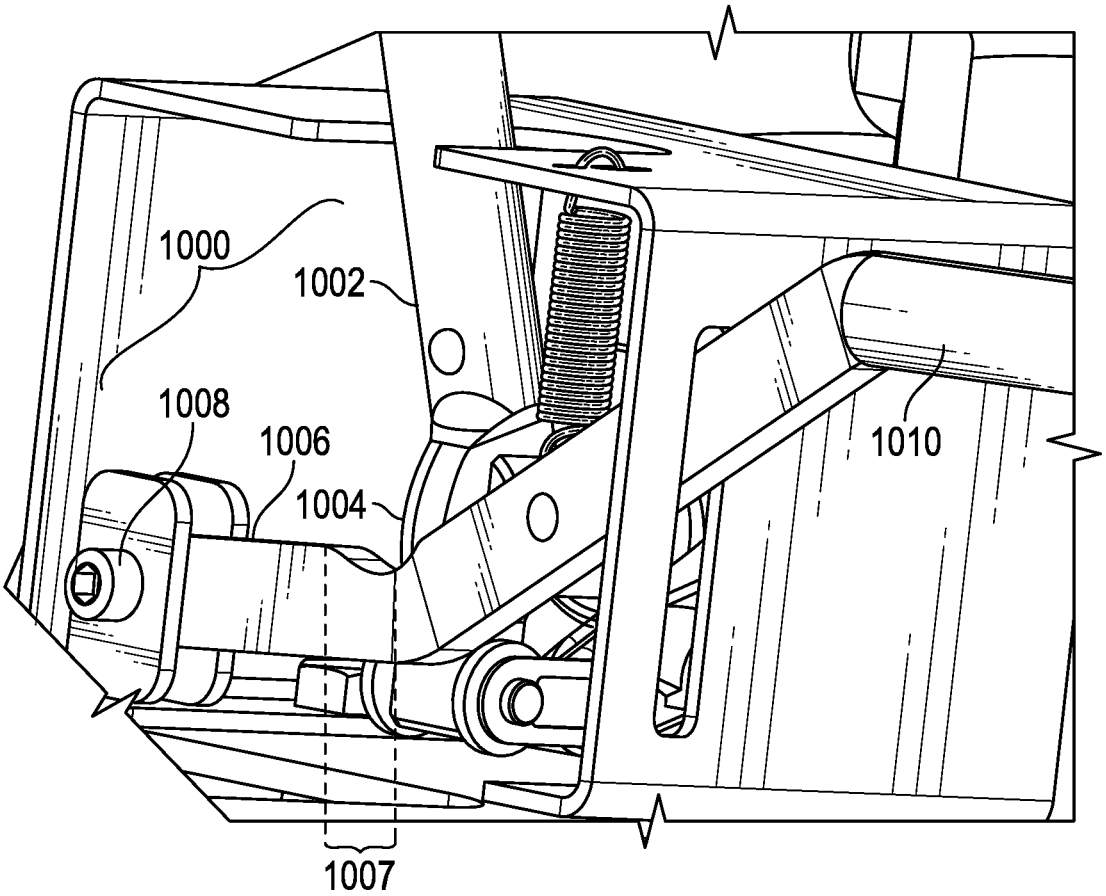
FIG. 10 is a detail view of a two factor (e.g., two handed) activation system shown in the locked position in accordance with various embodiments.

The two factor safety feature of the invention will now be described in conjunction with FIGS. 10 and 11. In particular, FIG. 10 illustrates an exemplary two handed activation system 1000 including a primary actuation lever 1002 and a secondary (safety) lever 1006. The primary lever 1002 is configured to pivot about a pivot mount (not shown), and includes a cam-like lobe 1004. The secondary lever 1006 is configured to pivot about a pivot mount 1008, and includes a handle 1010 and a recessed region 1007. As shown in FIG. 10, the activation system is in the locked position because the lobe 1004 abuts against the safety lever 1006 proximate the recess 1007.

Figure 11:
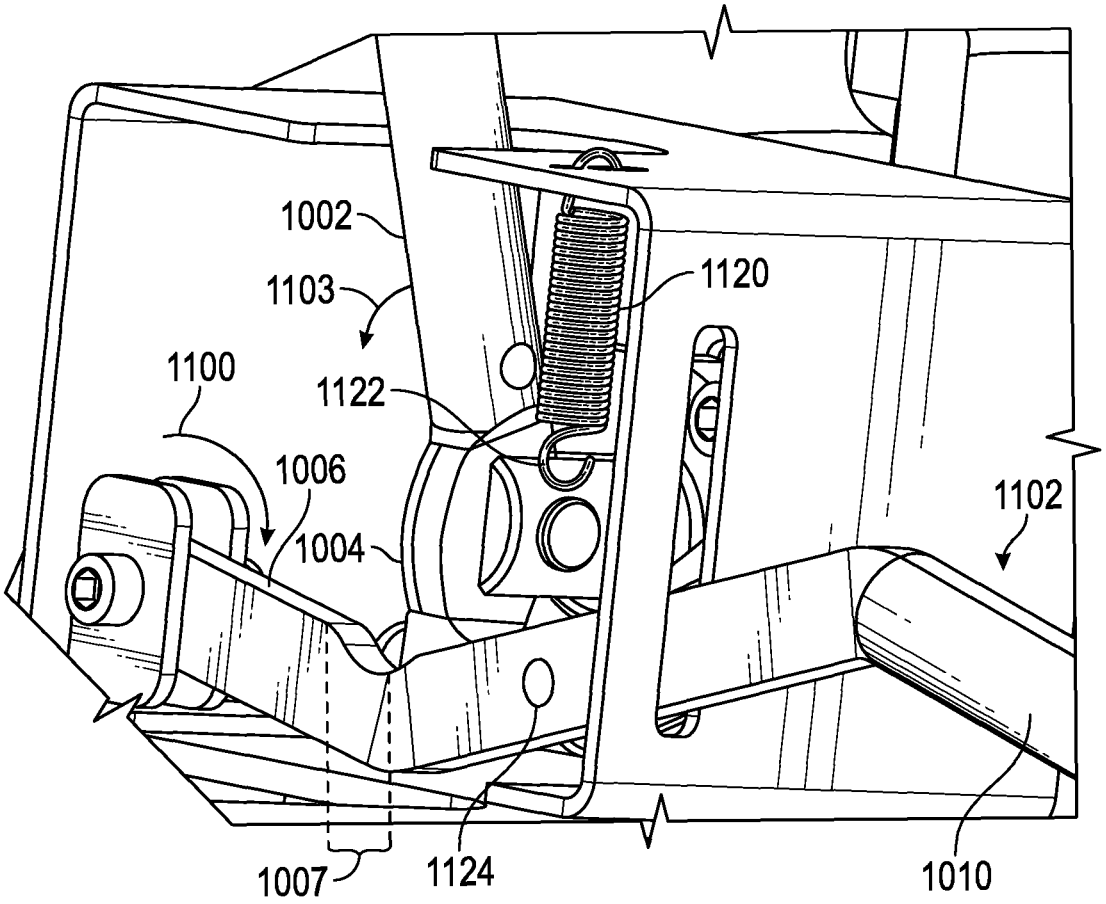
FIG. 11 is a detail view of the two factor activation system of FIG. 10 shown in the un-locked position in accordance with various embodiments.

With reference to FIG. 11, the activation system shown in the un-locked position. In particular, the safety lever 1006 is shown rotated in the direction of the arrow 1100 (by pressing downwardly on the handle 1010 along the direction of the arrow 1102). In this position, the recess 1007 is moved downwardly, providing clearance for the lobe 1004 and thereby allowing the primary lever 1002 to rotate in the direction of the arrow 1103 when pulled by the operator. A spring return mechanism includes a spring 1120 having a hooked end 1122 for receipt within a hole 1124 in the safety lever 1006 causes the safety lever 1106 to return to the locked position—and simultaneously urging the primary actuator lever 1002 to return to the deactivated position—when the operator lets go of the handle 1010.

Figure 12:
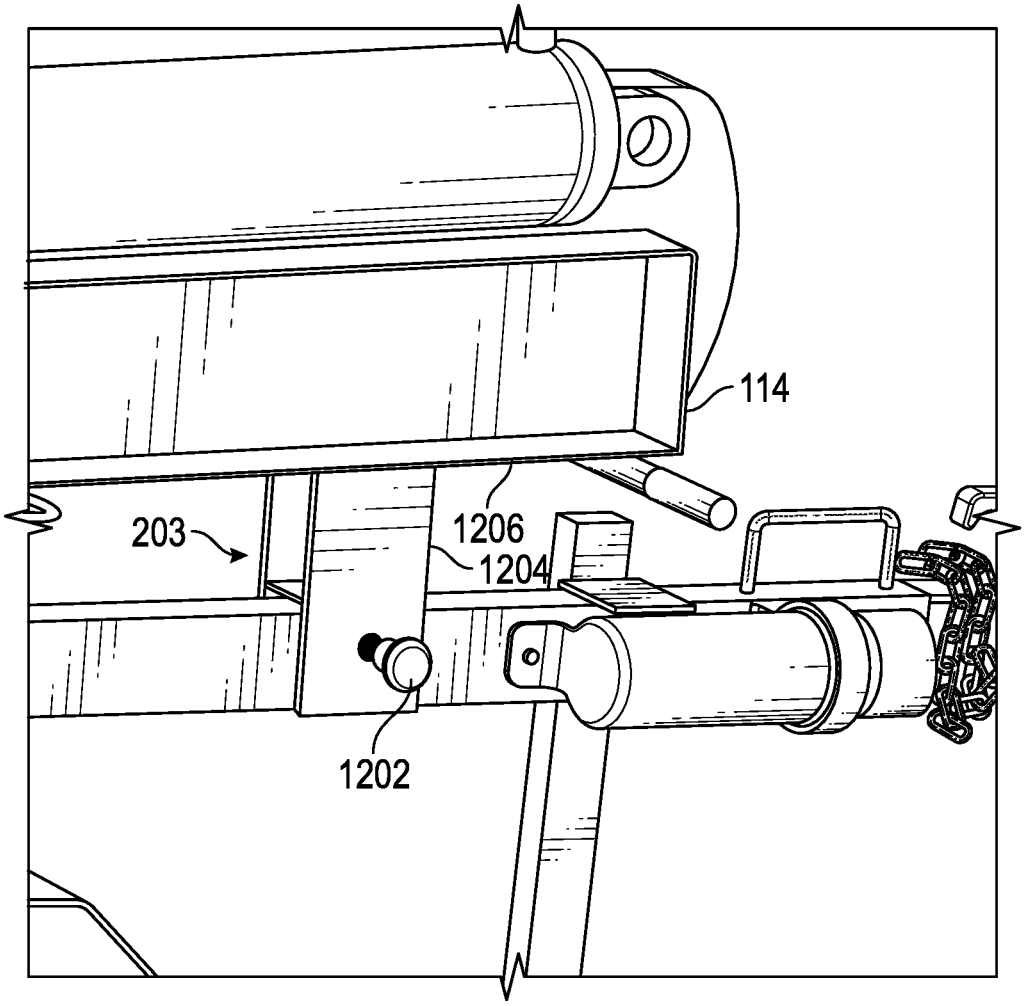
FIG. 12 is a perspective view of a release pin assembly for facilitating transition between vertical and horizontal splitting orientations in accordance with various embodiments.

Referring now to FIG. 12, a release pin assembly 203 (see also FIG. 2) is configured to releasably secure the log splitter in the horizontal position. The release pin assembly 203 includes a retractable pin 1202 which releasably extends through a bracket 1204 mounted to the underside 1206 of the I-beam 114 (see FIG. 1). When the pin 1202 is released, the operator may rotate the log splitter into a vertical position.

Figure 13:
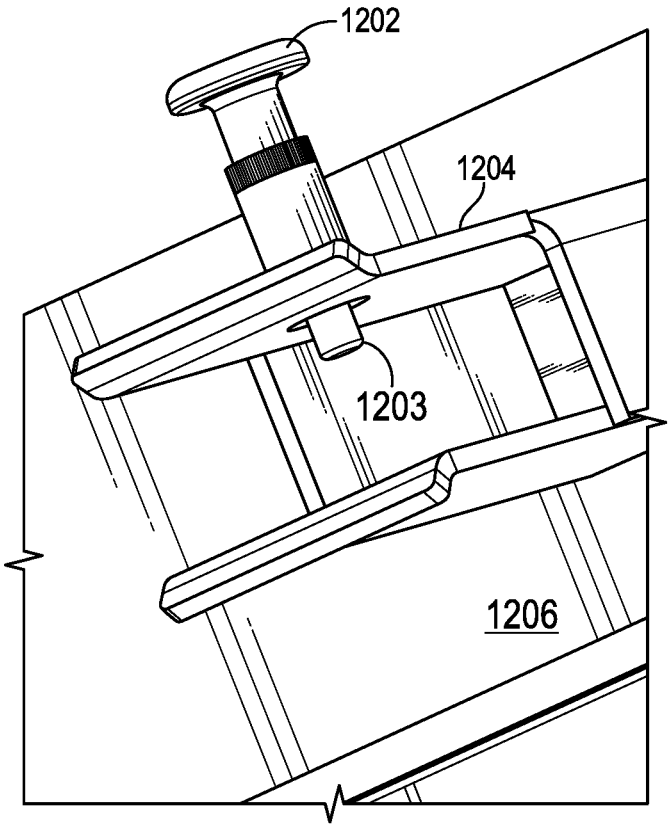
FIG. 13 is a close up view of the release mechanism of FIG. 12, shown with the pin retracted and the splitter assembly raised from the horizontal position in accordance with various embodiments.
Figure 14:
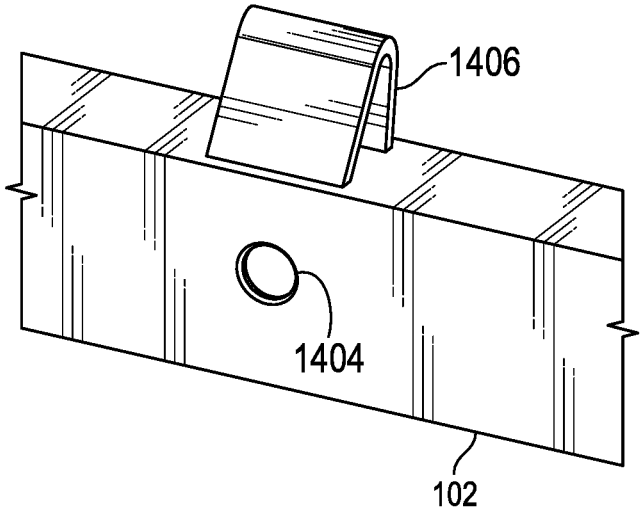
FIG. 14 is a close up view of a guide ramp to facilitate returning the log splitter to the horizontal position in accordance with various embodiments.

FIG. 13 is a close up view of the release mechanism of FIG. 12, shown with the pin 1202 retracted and the I-beam raised from the horizontal position. As shown in FIGS. 13 and 14, the pin 1202 extends through a hole 1404 in the chassis 102 (see FIG. 1) when the log splitter is locked in the horizontal position. When the log splitter returns to the horizontal position form the vertical position, a ramp 1406 helps guide the bracket 1204 back into alignment about the chassis 102, and positioning the pin 1202 proximate the hole 1404. In an embodiment, the pin 1202 is spring loaded, such that a distal end 1203 of the pin slides down a side of the ramp 1406 as the bracket 1204 closes onto the chassis 102 such that the pin 1202 is extended into the hole 1404 by the action of the internal spring (not shown).

Figure 15:
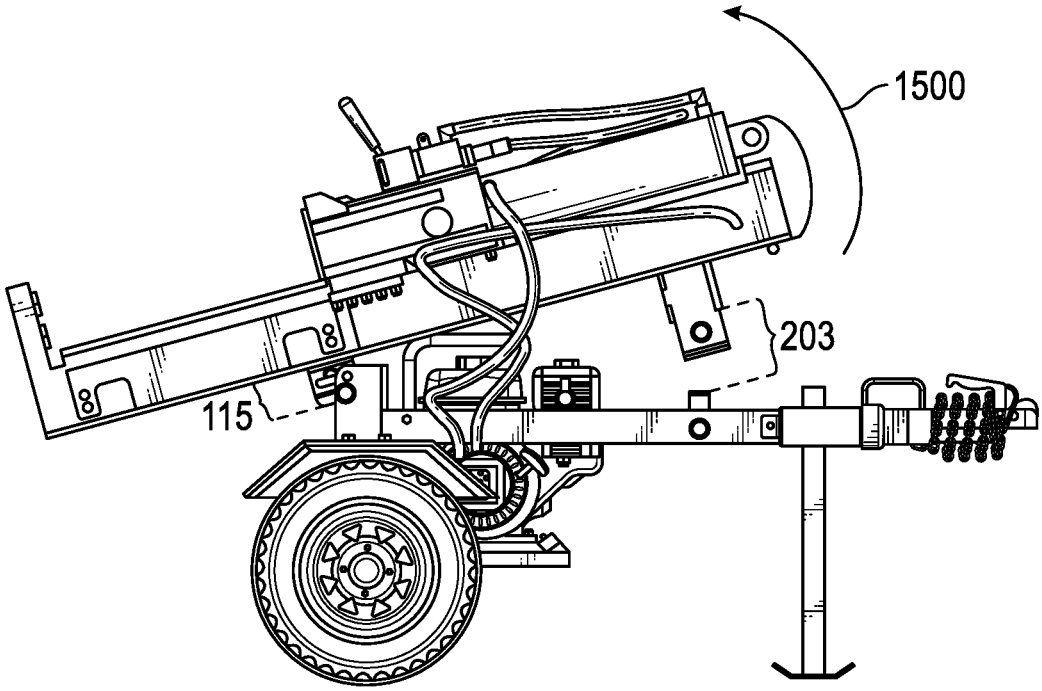
FIG. 15 is a side elevation view of the log splitter part way between the horizontal and vertical operation positions in accordance with various embodiments.
Figure 16:
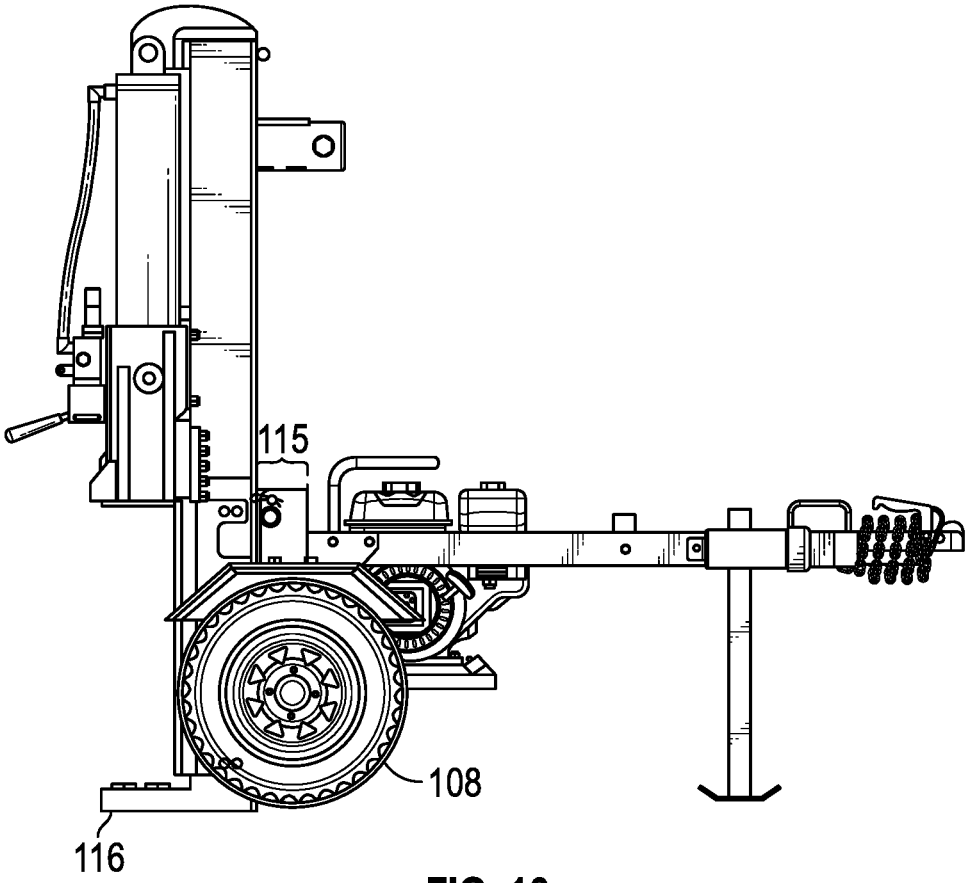
FIG. 16 depicts the log splitter of FIG. 15 fully extended into the vertical position in accordance with various embodiments.

After releasing the pin 1202, the operator rotates the log splitter about the pivot mechanism 115 along the direction of the arrow 1500, as shown in FIG. 15. When the log splitter reaches a substantially vertical orientation, as shown in FIG. 16, the end plate 116 is configured to rest on the ground. To accommodate variations in the terrain proximate the end plate 116 and wheels 108, an exemplary embodiment of the pivot mechanism 115 includes a pivot shaft extending through an elongated slot, as described in greater detail below in conjunction with FIG. 17.

Figure 17:
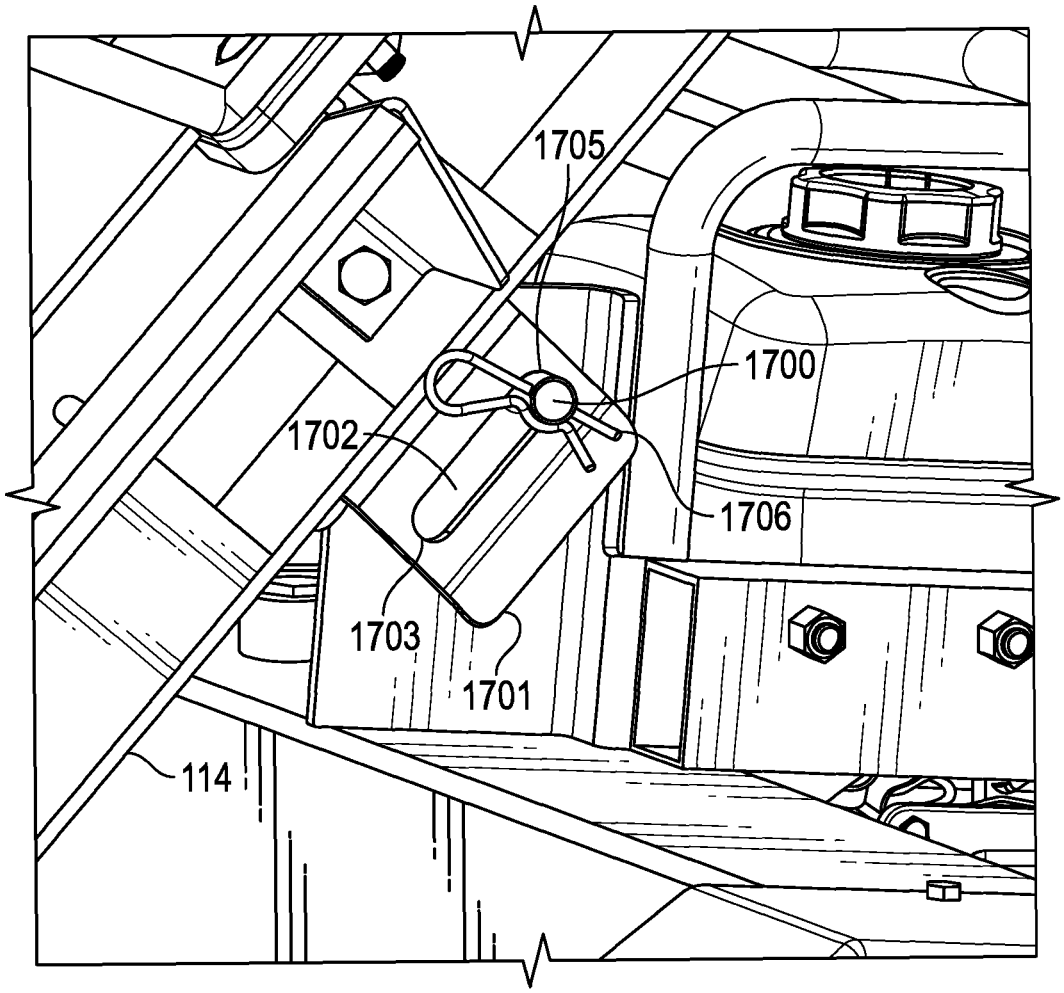
FIG. 17 is a close up view of a slotted bracket used to pivot the log splitter between the horizontal and vertical operating positions in accordance with various embodiments.

FIG. 17 is a close up view of a slotted bracket used to pivot the log splitter between the horizontal and vertical operating positions. More particularly, a supporting bracket 1701 extends from the I-beam 114. The bracket 1701 includes an elongated slot 1702 having a fore end 1705 and an aft end 1703. A pivot pin 1700 is mounted to the chassis and extends through the slot 1702, secured therein by a cotter pin 1706 in the illustrated embodiment. When the level of the ground proximate the end plate 116 is higher than the level of the ground proximate the wheels 108, the pivot pin 1700 is disposed at the aft end 1703 of the slot 1702. Conversely, when the level of the ground proximate the end plate 116 is lower than the level of the ground proximate the wheels 108, the pivot pin 1700 is disposed at the fore end 1705 of the slot 1702. In this way, the log splitter may remain stable in the vertical position notwithstanding small variations in the local height of the terrain in the region immediately surrounding the end plate 116.

Figure 18:
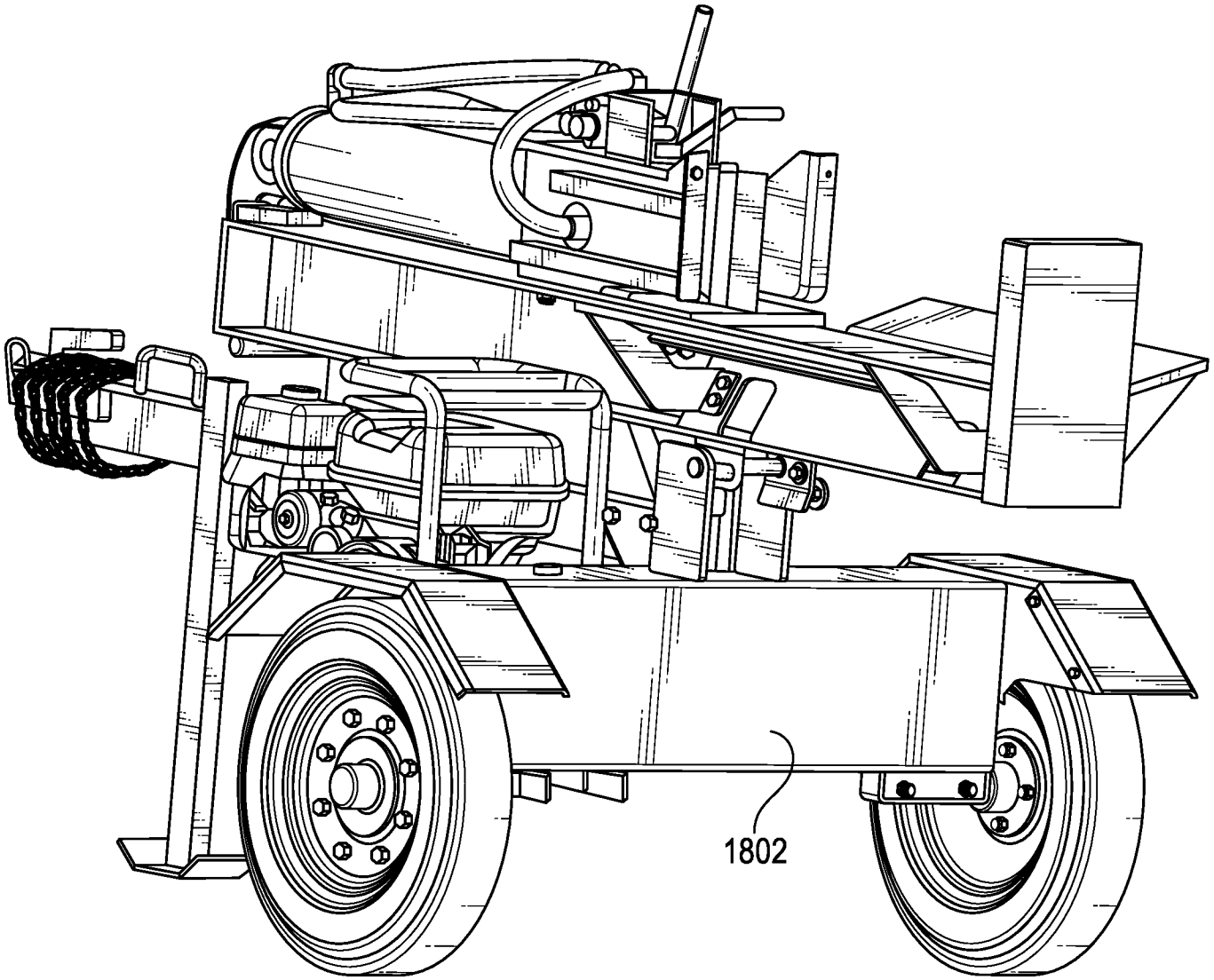
FIG. 18 is a rear perspective view of the log splitter showing the side-to-side mounted hydraulic tank in accordance with various embodiments.

FIG. 18 depicts a side-to-side mounted hydraulic tank 1802 in accordance with various embodiments. In this position, the hydraulic fluid inside the tank has a tendency to accumulate toward one side when the vehicle turns while being transported, potentially resulting in instability. To mitigate this effect, the present invention incorporates baffles into the tank.

Figure 19:
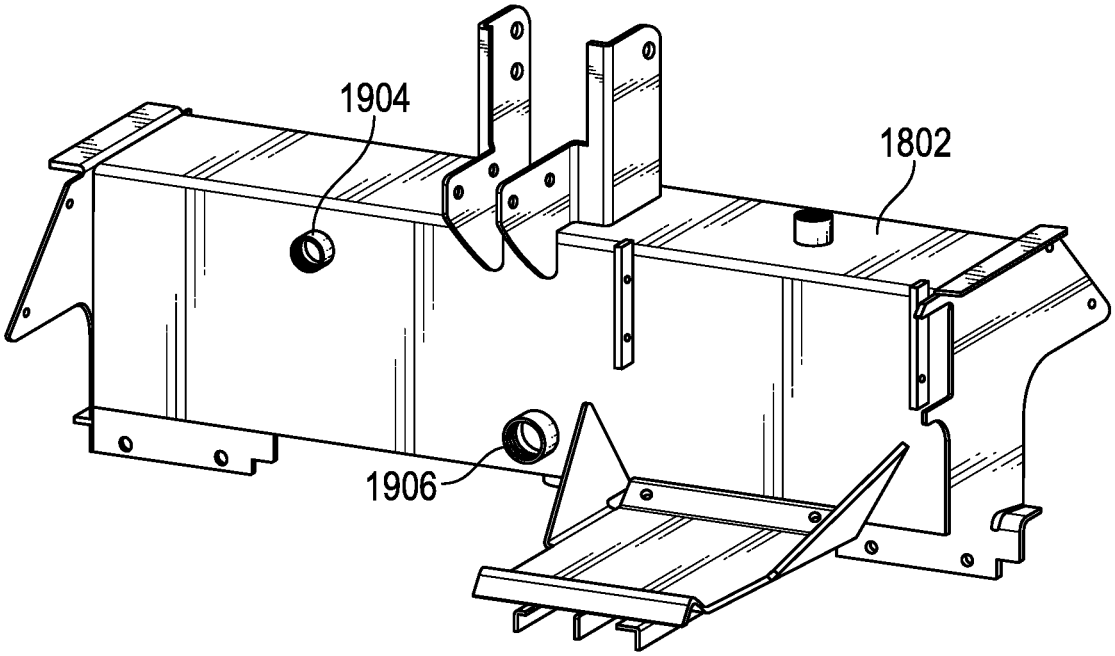
FIG. 19 is a front perspective view of the hydraulic tank of FIG. 18 showing respective inlet and outlet connections in accordance with various embodiments.
Figure 20:
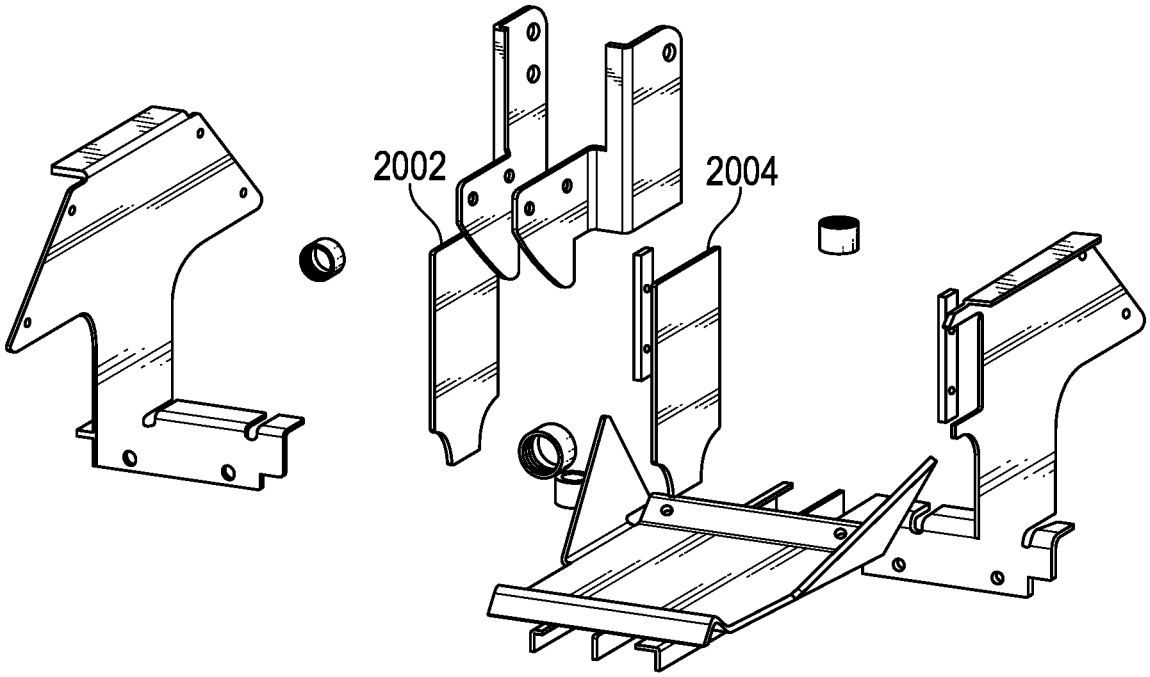
FIG. 20 is an exploded view of the baffle system used to stabilize fluid inside the tank of FIGS. 18 and 19 in accordance with various embodiments.

More particularly and referring now to FIGS. 19 and 20, a hydraulic tank 1802 includes an inlet port 1904 and an outlet port 1906. In the exploded view shown in FIG. 20, the tank housing is removed to reveal respective baffle structures 2002, 2004.

Various embodiments provide a log splitter comprising: a wedge mounting bracket comprising a mounting plate and a female slot; a removable wedge comprising a knife edge and a male adapter configured to be slideably received within the female slot of the wedge mounting bracket; a mounting bracket through hole; a wedge through hole configured to align with the mounting bracket through hole when the male adapter is positioned in the female slot of the wedge mounting bracket; and a fastener configured to releasably extend through the wedge through hole and the mounting bracket through hole, and configured to releasably secure the removable wedge in the wedge mounting bracket.

In an embodiment the log splitter further includes: a chassis; an I-beam positioned along a central longitudinal axis of the chassis, and comprising the wedge mounting bracket on a top surface of the I-beam; a slotted pivot mechanism configured to couple a bottom surface of the I-beam to the chassis, and for rotation of the I-beam between a horizontal mode and a vertical mode; an end plate coupled orthogonally to the I-beam on an end distal to the wedge mounting bracket; and a hydraulic piston coupled to the wedge mounting bracket and configured to drive the wedge toward the end plate.

In an embodiment the log splitter includes: a pair of wheels coupled to the chassis; a trailer tongue coupled to the chassis on an end distal to the slotted pivot mechanism; and a stand coupled to the chassis and configured to support the chassis in a substantially horizontal position.

In an embodiment a slotted pivot mechanism can be configured to allow the I-beam to move up or down to maintain a stable position in the vertical mode on an uneven surface.

In an embodiment the log splitter further includes: a hydraulic fluid tank configured to hold hydraulic fluid; a power plant mounted to the chassis and configured to move a portion of the hydraulic fluid from the hydraulic fluid tank and to pressurize the portion of the hydraulic fluid in the hydraulic piston; and at least one baffle configured to reduce transverse movement of the hydraulic fluid in the hydraulic fluid tank.

In an embodiment the log splitter further includes: a release assembly comprising an assembly through hole in at least one flange coupled to the bottom surface of the I-beam; a chassis through hole configured to align with the assembly through hole when the I-beam is in the horizontal mode; and a pin configured to releasably extend through the chassis through hole and the assembly through hole, and to releasably secure the I-beam in the horizontal mode.

In an embodiment the log splitter includes a log platform coupled to the I-beam between the end plate and the wedge mounting bracket, and configured to accept a log when the I-beam is in the vertical position or in the horizontal position.

In an embodiment the I-beam is substantially parallel to the chassis in the horizontal mode and the I-beam is substantially orthogonal to the chassis in the vertical mode.

Various embodiments provide a log splitter comprising: a trailer comprising a chassis having a central longitudinal axis, at least one pair of wheels coupled to the chassis along a lateral axis, a hitch tongue mounted on an end of the chassis along the central longitudinal axis, and a stand coupled to the chassis; an I-beam pivotally coupled to the chassis on an end distal to the hitch tongue and along the central longitudinal axis; an end stop coupled to an end of the I-beam; a hydraulic system configured to move a wedge toward the end stop; and a two factor activation system comprising a primary actuator and a secondary actuator, and configured to activate the hydraulic system upon actuation of both the primary actuator and the secondary actuator.

In an embodiment the log splitter includes a wedge mounting bracket comprising a mounting plate and a female slot, the wedge mounting bracket mounted on a top surface of the beam; and the wedge comprises a knife edge and a male adapter configured to be slideably received within the female slot of the wedge mounting bracket.

In an embodiment the log splitter further includes: a mounting bracket through hole; a wedge through hole configured to align with the mounting bracket through hole when the male adapter is positioned in the female slot of the wedge mounting bracket; and a fastener configured to releasably extend through the wedge through hole and the mounting bracket through hole, and configured to releasably secure the removable wedge in the wedge mounting bracket.

In an embodiment the log splitter further includes a hard stop mounted on the wedge mounting bracket, and configured to remove a log from the wedge as the hydraulic system returns the wedge to a starting position.

In an embodiment the hydraulic system includes a hydraulic fluid tank having at least one internal baffle configured to reduce transverse movement of hydraulic fluid in the tank, for example, during a sharp turn while the log splitter is being transported.

In some embodiments, the primary actuator is configured to be actuated before the secondary actuator can be actuated.

In some embodiments, the primary actuator comprises a primary handle and the secondary actuator comprises a secondary handle; the primary actuator and the secondary actuator are positioned proximate the wedge mounting bracket; and the primary handle extends through a front portion of the wedge mounting bracket and the secondary extends through a side portion of the wedge mounting bracket.

Various embodiments provide a method of using a log splitter comprising the steps of: providing a log splitter comprising: a chassis; an I-beam positioned along a central longitudinal axis of the chassis; a slotted pivot mechanism configured to couple a bottom surface of the I-beam to the chassis, and to rotate of the I-beam between a horizontal mode and a vertical mode; a wedge mounting bracket mounted in a top surface of the I-beam and comprising a mounting plate and a female slot; a removable wedge comprising a knife edge and a male adapter configured to be slideably received within the female slot of the wedge mounting bracket; a mounting bracket through hole; a wedge through hole configured to align with the mounting bracket through hole when the male adapter is positioned in the female slot of the wedge mounting bracket; a fastener configured to releasably extend through the wedge through hole and the mounting bracket through hole, and configured to releasably secure the removable wedge in the wedge mounting bracket; an end plate coupled orthogonally to the I-beam on an end distal to the wedge mounting bracket; and a hydraulic piston coupled to the wedge mounting bracket and configured to drive the wedge toward the end plate; positioning a log on the end plate; driving the wedge toward the end plate; and splitting the log with wedge.

In an embodiment the method further includes: removing the fastener from the wedge through hole and the mounting bracket through hole; and releasing the removable wedge from the wedge mounting bracket.

In an embodiment the method further includes: rotating the I-beam to a vertical mode; and positioning the end plate on a surface.

In an embodiment the method further includes: moving the I-beam up or down in the slotted pivot mechanism; and stabilizing the I-beam in the vertical mode on an uneven surface.

In an embodiment the method further includes: operating a two-handed safety system comprising a primary actuator and a secondary actuator; simultaneously actuating both the primary actuator and the secondary actuator; and activating the hydraulic piston.

As used herein, the word "exemplary" means "serving as an example, instance, or illustration." Any implementation described herein as "exemplary" is not necessarily to be construed as preferred or advantageous over other implementations, nor is it intended to be construed as a model that must be literally duplicated.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

The invention claimed is:

1. A log splitter comprising:

a wedge mounting bracket comprising a mounting plate and a female slot;

a removable wedge comprising a knife edge and a male adapter configured to be slideably received within the female slot of the wedge mounting bracket such that the female slot extends at least the full length of the male adapter, and the knife edge, the axis of the female slot, and the axis of the male adapter are oriented parallel to each other further comprising:

a mounting bracket through hole disposed in the mounting bracket;

a wedge through hole disposed within the removable wedge and configured to align with the mounting bracket through hole when the male adapter is received within the female slot of the wedge mounting bracket; and a fastener configured to releasably extend through the wedge through hole and the mounting bracket through hole, and configured to releasably secure the removable wedge in the wedge mounting bracket.

2. The log splitter according to claim 1 further comprising:

a chassis;

an I-beam positioned along a central longitudinal axis of the chassis, the wedge mounting bracket being secured to a top surface of the I-beam;

a slotted pivot mechanism configured to couple a bottom surface of the I-beam to the chassis, and for rotation of the I-beam between a horizontal mode and a vertical mode;

an end plate coupled to the I-beam on an end distal to the wedge mounting bracket; and a hydraulic piston coupled to the wedge mounting bracket and configured to drive the wedge toward the end plate.

3. The log splitter according to claim 2, wherein the slotted pivot mechanism is configured to selectively allow the I-beam to move up and down to maintain a stable position on an uneven surface.

4. The log splitter according to claim 1, further comprising:

a hydraulic fluid tank configured to hold hydraulic fluid;

a power plant mounted to the chassis and configured to move a portion of the hydraulic fluid from the hydraulic fluid tank and to pressurize the portion of the hydraulic fluid in the hydraulic piston; and at least one baffle configured to reduce transverse movement of the hydraulic fluid in the hydraulic fluid tank.

5. The log splitter according to claim 2, further comprising:

a release assembly comprising an assembly through hole in at least one flange coupled to the bottom surface of an I-beam;

a chassis through hole configured to align with the assembly through hole when the I-beam is in the horizontal mode; and a pin configured to releasably extend through the chassis through hole and the assembly through hole, and to releasably secure the I-beam in the horizontal mode.

6. The log splitter according to claim 2, further comprising a log platform coupled to the I-beam between the end plate and the wedge mounting bracket, and configured to accept a log when the I-beam is in the vertical position or in the horizontal position.

7. The log splitter according to claim 2, wherein the I-beam is parallel to the chassis in the horizontal mode and the I-beam is substantially orthogonal to the chassis in the vertical mode.

8. A log splitter comprising:

a trailer comprising a chassis having a central longitudinal axis, at least one pair of wheels coupled to the chassis along a lateral axis, a hitch tongue mounted on an end of the chassis along the central longitudinal axis, and a stand coupled to the chassis;

an I-beam pivotally coupled to the chassis on an end distal to the hitch tongue and along the central longitudinal axis;

an end stop coupled to an end of the I-beam;

a hydraulic system configured to move a removable wedge toward the end stop;

a two factor activation system comprising a primary actuator and a secondary actuator, and configured to activate the hydraulic system upon actuation of both the primary actuator and the secondary actuator; and a wedge mounting bracket comprising a mounting plate and a female slot, wherein the removable wedge includes a knife edge and a male adapter configured to be slideably received within the female slot of the wedge mounting bracket such that the female slot extends at least the full length of the male adapter, and the knife edge, the axis of the female slot, and the axis of the male adapter are oriented parallel to each other.

9. The log splitter according to claim 8, further comprising:

a wedge mounting bracket comprising a mounting plate and a female slot, the wedge mounting bracket mounted on a top surface of the beam; and the wedge comprises a knife edge and a male adapter configured to be slideably received within the female slot of the wedge mounting bracket.

10. The log splitter according to claim 9, further comprising:

a mounting bracket through hole;

a wedge through hole configured to align with the mounting bracket through hole when the male adapter is positioned in the female slot of the wedge mounting bracket; and a fastener configured to releasably extend through the wedge through hole and the mounting bracket through hole, and configured to releasably secure the removable wedge in the wedge mounting bracket.

11. The log splitter according to claim 9, further comprising a hard stop mounted on the wedge mounting bracket, and configured to remove a log from the wedge as the hydraulic system returns the wedge to a starting position.

12. The log splitter according to claim 8, wherein the hydraulic system comprises a hydraulic fluid tank having at least one internal baffle configured to reduce transverse movement of hydraulic fluid in the tank.

13. The log splitter according to claim 8, wherein the primary actuator is configured to be actuated before the secondary actuator can be actuated.

14. The log splitter according to claim 9, wherein the primary actuator comprises a primary handle and the secondary actuator comprises a secondary handle;

the primary actuator and the secondary actuator are positioned in the wedge mounting bracket; and the primary handle extends through a front portion of the wedge mounting bracket and the secondary extends through a side portion of the wedge mounting bracket.

15. A method of using a log splitter comprising the steps of:

providing a log splitter comprising:

a chassis;

an I-beam positioned along a central longitudinal axis of the chassis;

a slotted pivot mechanism configured to couple a bottom surface of the I-beam to the chassis, and to rotate of the I-beam between a horizontal mode and a vertical mode;

a wedge mounting bracket mounted in a top surface of the I-beam and comprising a mounting plate and a female slot;

a removable wedge comprising a knife edge and a male adapter configured to be slideably received within the female slot of the wedge mounting bracket such that the female slot extends at least the full length of the male adapter, and the knife edge, the axis of the female slot, and the axis of the male adapter are oriented parallel to each other;

a mounting bracket through hole;

a wedge through hole configured to align with the mounting bracket through hole when the male adapter is positioned in the female slot of the wedge mounting bracket;

a fastener configured to releasably extend through the wedge through hole and the mounting bracket through hole, and configured to releasably secure the removable wedge in the wedge mounting bracket;

an end plate coupled orthogonally to the I-beam on an end distal to the wedge mounting bracket; and a hydraulic piston coupled to the wedge mounting bracket and configured to drive the wedge toward the end plate;

positioning a log on the end plate;

driving the wedge toward the end plate; and splitting the log with wedge.

16. The method according to claim 15, further comprising the steps of:

removing the fastener from the wedge through hole and the mounting bracket through hole; and releasing the removable wedge from the wedge mounting bracket.

17. The method according to claim 15, further comprising the steps of:

rotating the I-beam to a vertical mode; and positioning the end plate on a surface.

18. The method according to claim 17, further comprising the steps of:

moving the I-beam up or down in the slotted pivot mechanism; and stabilizing the I-beam in the vertical mode on an uneven surface.

19. The method according to claim 15, further comprising the steps of:

operating a two-handed safety system comprising a primary actuator and a secondary actuator;

simultaneously actuating both the primary actuator and the secondary actuator; and activating the hydraulic piston.

* * * * *